US007568953B1

(12) United States Patent
Ho et al.

(10) Patent No.: US 7,568,953 B1
(45) Date of Patent: Aug. 4, 2009

(54) ELECTRICAL CONNECTOR

(75) Inventors: Hsin-Tsung Ho, Tu-Cheng (TW); Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/330,886

(22) Filed: Dec. 9, 2008

(51) Int. Cl.
*H01R 24/00* (2006.01)

(52) U.S. Cl. ..... 439/630; 439/654

(58) Field of Classification Search ..... 439/630, 439/638, 654, 945, 541.5
See application file for complete search history.

(56) References Cited

U.S. PATENT DOCUMENTS 6,468,101 B2 * 10/2002 Suzuki ..... 439/326
6,857,907 B1 2/2005 Hung et al.
6,881,097 B2 * 4/2005 Matsunaga et al. ..... 439/630
6,944,028 B1 * 9/2005 Yu et al. ..... 439/328
6,988,659 B2 * 1/2006 Fukuda ..... 439/630
7,338,326 B2 * 3/2008 Su ..... 439/638
7,361,056 B1 * 4/2008 Liu ..... 439/630

* cited by examiner

*Primary Examiner*—Tho D Ta

(57) ABSTRACT

An electrical connector adapted for receiving a first electronic card and a second electronic card has a first connector element that includes a first base having a first body, and a set of first terminals received in the first base. Two lateral walls and two holding walls extending upwards and downwards from two opposite sides of the first body to form a first receiving space and a receiving chamber therebetween respectively. The first receiving space, with a first insertion opening defined, is adapted for receiving the first electronic card. A second connector element removably received in the receiving chamber includes a second base, a set of second terminals mounted in the second base and a second shell. The second shell is engaged with the second base to form a second receiving space, with a second insertion opening defined opposite to the first insertion opening, for receiving the second electronic card.

3 Claims, 4 Drawing Sheets

ELECTRICAL CONNECTOR

BACKGROUND OF THE INVENTION

1. Field of the Invention

The present invention relates to a connector, and particularly to an electrical connector capable of receiving two electronic cards.

2. The Related Art

With the ever-increasing miniaturization and multifunction of portable electronic devices, such as mobile phones, digital video cameras and the like, it is necessary to insert different types of electronic cards into the portable electronic device for data processing, identifying function and so on, and to reduce the occupied space in the portable electronic device. Therefore, an electrical connector presently disclosed, which allows inserting two electronic cards thereinto at a time for meeting the present demand.

For instance, related U.S. application Ser. No. 10/721,202, filed Nov. 25, 2003, entitled "Electrical Connector Adapted For Use With First And Second Electronic Cards", which is incorporated herein by reference, presents an electrical connector structure that can receive the first electronic card inserted into a first card receiving space and the second electronic card inserted into a second card receiving space. However, such structure is not convenient to insert the electronic cards thereinto, because an insertion opening of the first card receiving space is adjacent to that of the second card receiving space. Furthermore, once the first electronic card or the second electronic card cannot connect with the electrical connector functionally, the electrical connector will be entirely replaced, which reduces the usage life of the electrical connector.

SUMMARY OF THE INVENTION

Accordingly, an object of the present invention is to provide an electrical connector which has two separately removable elements for accommodating a first electronic card and a second electronic card. The electrical connector has a first connector element that includes a first base having a first body, and a set of first terminals received in the first base. Two lateral walls and two holding walls extending upwards and downwards from two opposite sides of the first body to form a first receiving space and a receiving chamber therebetween respectively. The first receiving space, with a first insertion opening defined, is adapted for receiving the first electronic card. A second connector element removably received in the receiving chamber includes a second base, a set of second terminals mounted in the second base and a second shell. The second shell is engaged with the second base to form a second receiving space, with a second insertion opening defined opposite to the first insertion opening, for receiving the second electronic card.

As described above, the second connector element is removably received in the receiving chamber of the first connector element, which is not only capable of receiving the first and second electronic cards, but also reduces occupied horizontal space of the electrical connector. Meanwhile, the first connector element or the second connector element can be alternatively exchanged when either the first connector element or the second connector element has a breakdown, which prolongs the usage life and reduces the manufacturing cost of the electrical connector. In addition, the first insertion opening disposed opposite to the second insertion opening benefits for convenient insertion of the electronic cards.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
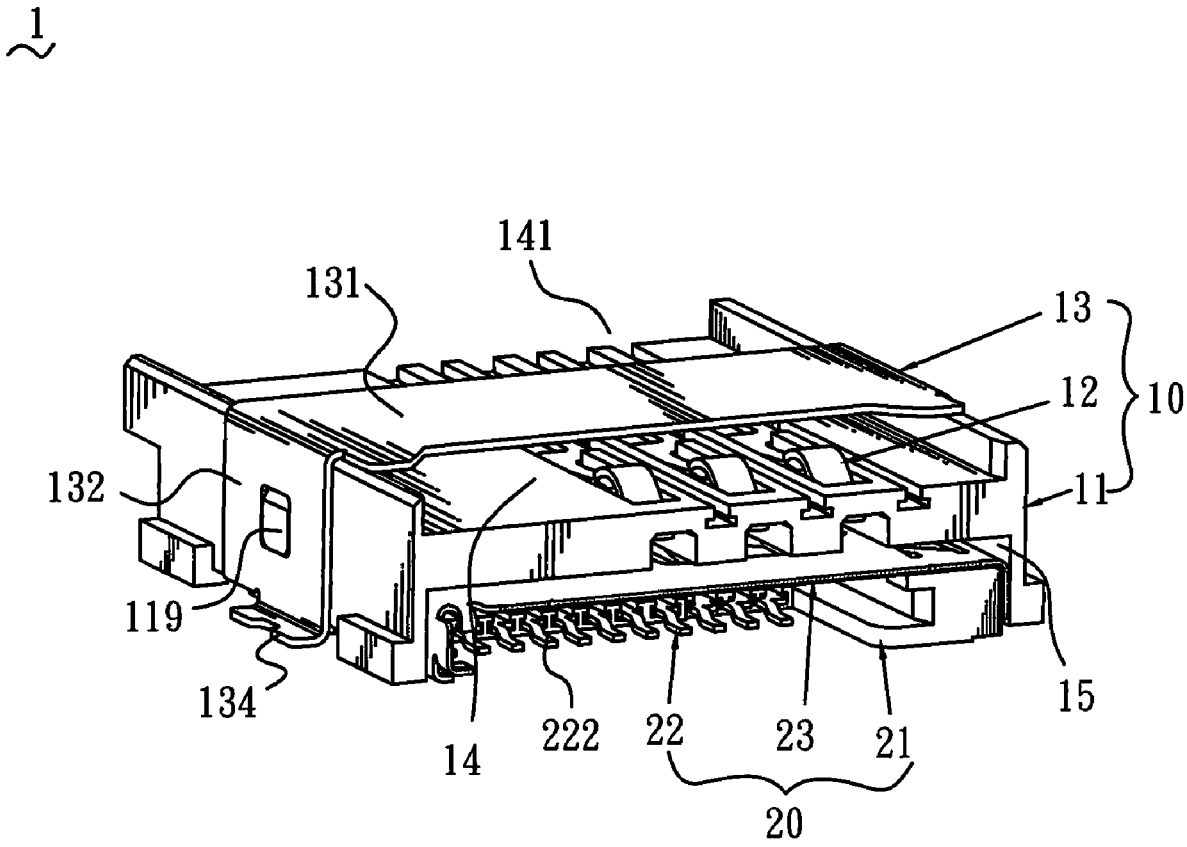
FIG. 1 is an assembled, perspective view of an electrical connector according to an embodiment of the present invention.

With reference to FIG. 1, an embodiment of an electrical connector 1 according to the present invention is shown. The electrical connector 1 includes a first connector element 10 and a second connector element 20 underlying the first connector element 10. Herein, one end of the second connector element 20 for receiving a second electronic card C2 (see FIG. 6) is defined as a front of the electrical connector 1, while the other end is defined a rear of the electrical connector 1 for describing the electrical connector 1 clearly.

Figure 2:
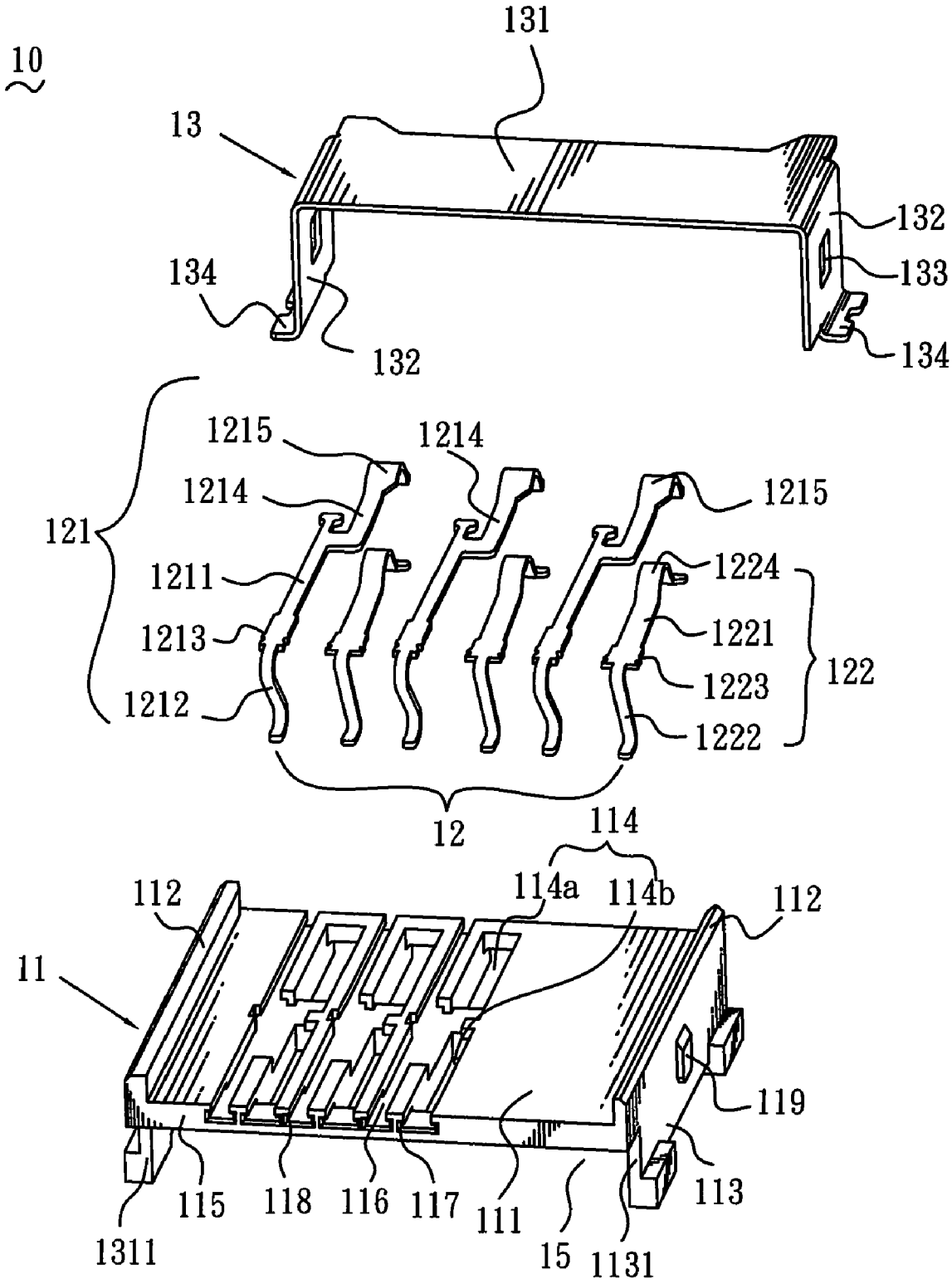
FIG. 2 is an exploded, perspective view of a first connector element of the electrical connector shown in FIG. 1 seen from another view.

Please refer to FIG. 2, the first connector element 10 includes a first base 11, a set of first terminals 12 received in the first base 11, and a first shell 13 coupled with the first base 11. The first base 11 has a first body 111 of rectangular shape, a pair of lateral walls 112 extending upwards from two opposite sides of the first body 111, and a pair of holding walls 113 extending downwards from the opposite sides of the first body 111 and each of which defines a notch 1131 at a rear end thereof for indicating assembling position of the second connector element 20 for avoiding influence on the first terminals 12. The first body 111 has a plurality of first terminal grooves 114 extending frontward and backwards and defines a rear surface 115. Each of the first terminal grooves 114 comprises a front groove 114*a* and a rear groove 114*b*. The rear groove 114*b* is disposed in alignment with the front groove 114*a* and reaches the rear surface 115. Two opposite bottom sides of the rear groove 114*b* extend oppositely to form a pair of first buckling recesses 117 passing through the rear surface 115. A fixing recess 116 is located between the two adjacent rear grooves 114*b* and partly communicates with the front groove 114*a* and the corresponding rear groove 114*b*. Two opposite bottom sides of the fixing recess 116 extend oppositely to form a pair of second buckling recesses 118.

Figure 3:
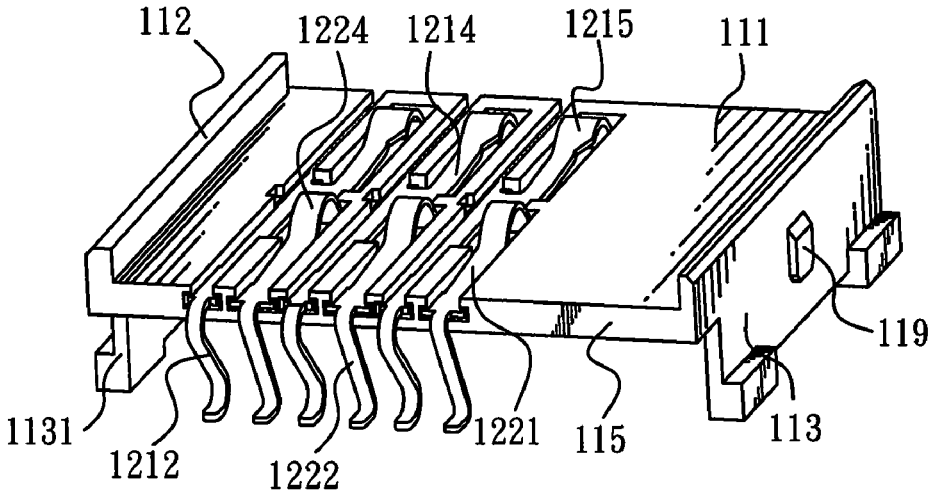
FIG. 3 is an assembled, perspective view of the first connector element shown in FIG. 2, wherein a first shell is removed.

Referring to FIG. 2 and FIG. 3, the first terminal 12 includes a long terminal 121 and a short terminal 122. The long terminal 121 has a first fixing portion 1211 of substantially strip shape received in the fixing recess 116. One end of the first fixing portion 1211 is extended downwardly to form a first soldering portion 1212 soldered on a printed circuit board (PCB, not shown). Two opposite sides of the end of the first fixing portion 1211 protrudes oppositely to form a first buckling portion 1213 adjacent to the first soldering portion 1212, respectively, for coupling with the second buckling recesses 118. The other end of the first fixing portion 1211 has a side extending perpendicular to the first fixing portion 1211 a short distance and then bending frontward to form a first connecting portion 1214 received in the front groove 114*a*. The first connecting portion 1214 is substantially parallel to the first fixing portion 1211. A distal end of the first connecting portion 1214 is extended obliquely and upwards, and curved downwards to form a first contacting portion 1215. The first contacting portion 1215 is substantially an arc-shape for connecting with a first electronic card C1 (see FIG. 6) smoothly.

The short terminal 122 has a second fixing portion 1221 of substantially rectangular shape. One end of the second fixing portion 1221 is extended downwards to form a second soldering portion 1222 which is narrower than the second fixing portion 1221 and soldered on the PCB, while the other end of the second fixing portion 1221 is bent obliquely and upwards, and then curved downwardly to form a second contacting portion 1224 similar to the first contacting portion 1215 for connecting with the first electronic card C1. Two sides of the second fixing portion 1221 protrudes oppositely to form a second buckling portion 1223 adjacent to the second soldering portion 1222, respectively, for engaging with the first buckling recess 117.

Please refer to FIGS. 1-2, the first shell 13 coupled with the first base 11 defines a first covering plate 131 and two first lateral plates 132 which extend downwards from two opposite sides of the first covering plate 131 and flank two opposite sides of the first base 11. The first lateral plate 132 has a mating portion 133 in the form of aperture. Each of the two opposite sides of the first base 11 is formed with an engaging portion 119 in the form of protrusion corresponding to the mating portion 133 for fixing the first shell 13 and the first base 11. A bottom edge of the first lateral plate 132 is bent outwards to form a soldering piece 134 for fixing the first connector element 10. Thus, the first body 111, the lateral walls 112 and the first shell 13 defines a first receiving space 14, with a first insertion opening 141 defined at a rear end of the electrical connector 1, for accommodating the first electronic card C1, while the first body 111 and the holding walls 113 form a receiving chamber 15 for receiving the second connector element 20.

Figure 4:
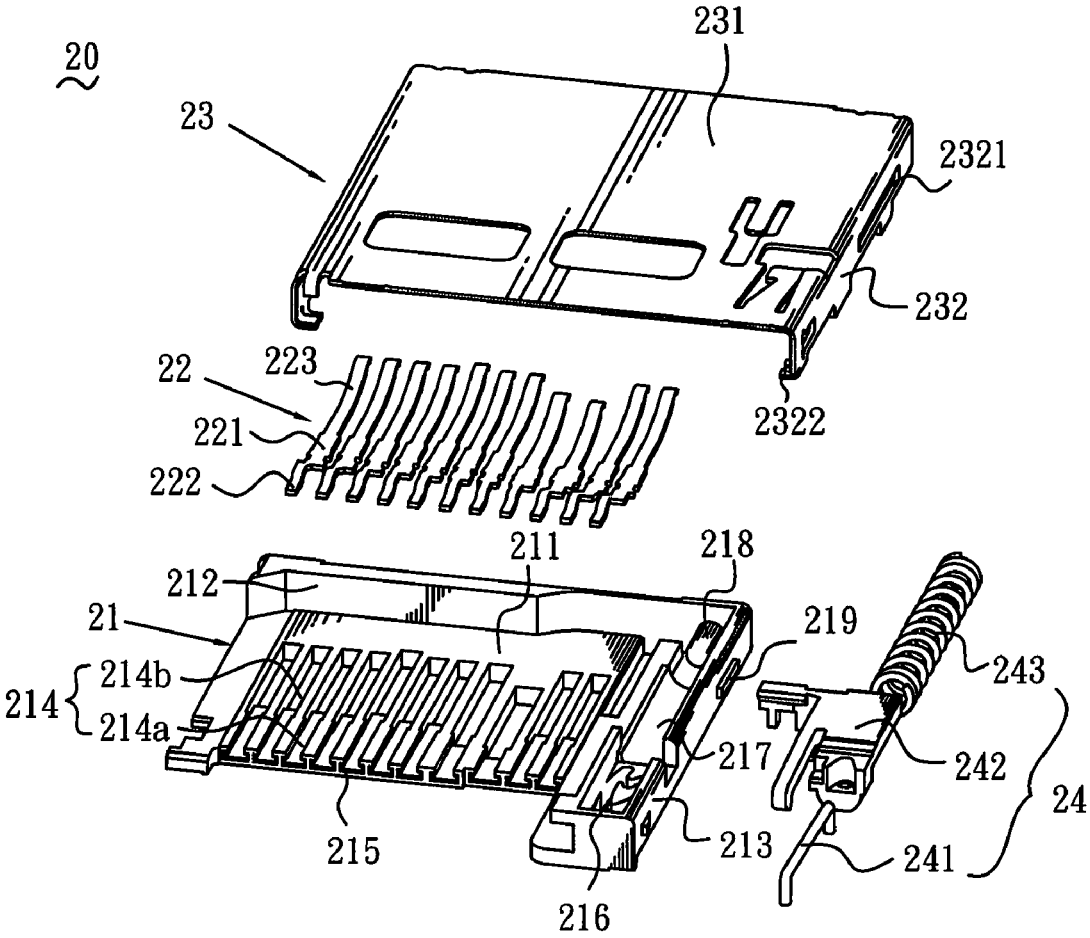
FIG. 4 is an exploded, perspective view of a second connector element of the electrical connector shown in FIG. 1.
Figure 5:
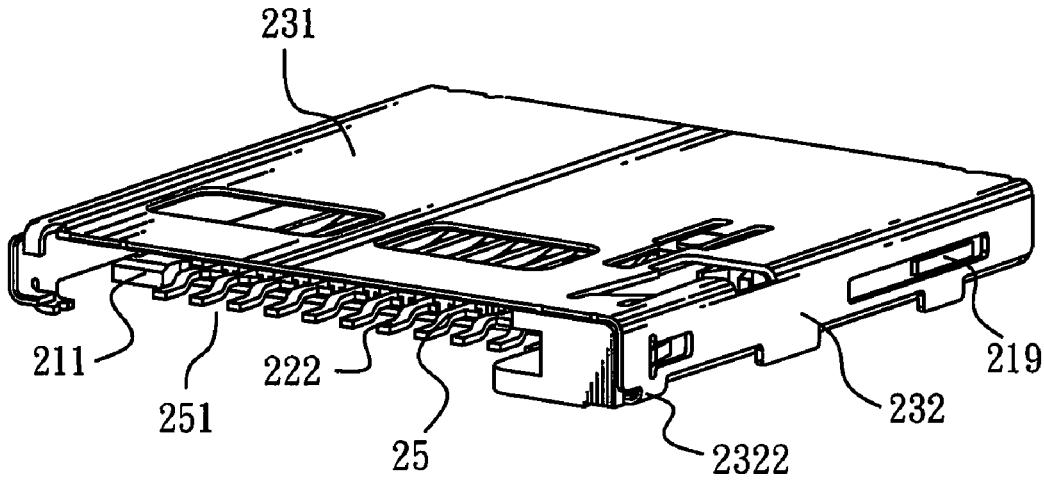
FIG. 5 is an assembled, perspective view of the second connector element shown in FIG. 4.

Referring to FIG. 4 and FIG. 5, the second connector element 20 of substantially rectangular shape includes a second base 21, a set of second terminals 22 mounted in the second base 21 and a second shell 23 engaged with the second base 21. The second base 21 includes a second body 211, a first blocking wall 212 extending upwards from a rear end of the second body 211 and a second blocking wall 213 extending upwards from a side of the second body 211 and connecting with the first blocking wall 212. The second body 211 has a plurality of terminal cavities 214 extending frontward and backward. The terminal cavity 214 includes a first cavity 214*a* and a second cavity 214*b* in alignment with the first cavity 214*a* and close to the first blocking wall 212. The first cavity 214*a* passes through a front end of the second body 211, with two buckling cavities 215 formed at two opposite sides of the first cavity 214*a*, while the second cavity 214*b* communicates with the first cavity 214*a* and reaches a bottom surface of the second body 211. The second body 211 further includes a heart-shaped recess 216, a sliding recess 217 and a positioning portion 218, which are aligned with one another and adjacent to the second blocking wall 213 for receiving an ejection mechanism 24. The first blocking wall 212 and the second blocking wall 213 respectively have a fixing protrusion 219 at an outer surface thereof.

The second terminal 22 includes a fixing portion 221, a soldering portion 222 and a contacting portion 223. The fixing portion 221 is a flat-plate shape and accommodated in the first cavity 214*a*, with two opposite sides thereof restrained in the corresponding buckling cavities 215. The soldering portion 222 is extended downwardly from a front end of the fixing portion 221 for being soldered on the PCB. The contacting portion 223 extended backwards from a rear end of the fixing portion 221 is narrower than the fixing portion 221 and received in the second cavity 214*b*, a distal end thereof formed an arc shape to exceed a top surface of the second body 211 for electrically connecting with the second electronic card C2.

The second shell 23 includes a second covering plate 231 and three second lateral plates 232 extending downwardly from three contiguous edges of the second covering plate 231. The second lateral plates 232 respectively have a fixing hole 2321 corresponding to the fixing protrusion 219 for fixing the second shell 23 to the second base 21. A bottom of the second lateral plate 232 extends downwards to form a plurality of buckling tabs 2322 bent inwards to button a bottom surface of the second base 21 in assembly. The second shell 23 is coupled with the second base 21 to form a second receiving space 25, with a second insertion opening 251 defined at a front end of the electrical connector 1, for receiving the second electronic card C2.

The ejection mechanism 24 mounted in the second base 21 includes a leading rod 241, a sliding member 242 and a spring 243. The leading rod 241 is received in the heart-shaped recess 216, the sliding member 242 is mounted in the sliding recess 217, and the spring 243 is disposed elastically between the sliding member 242 and the positioning portion 218. The positioning portion 218 is inserted into an end of the spring 243 for preventing the spring 243 from moving.

Figure 6:
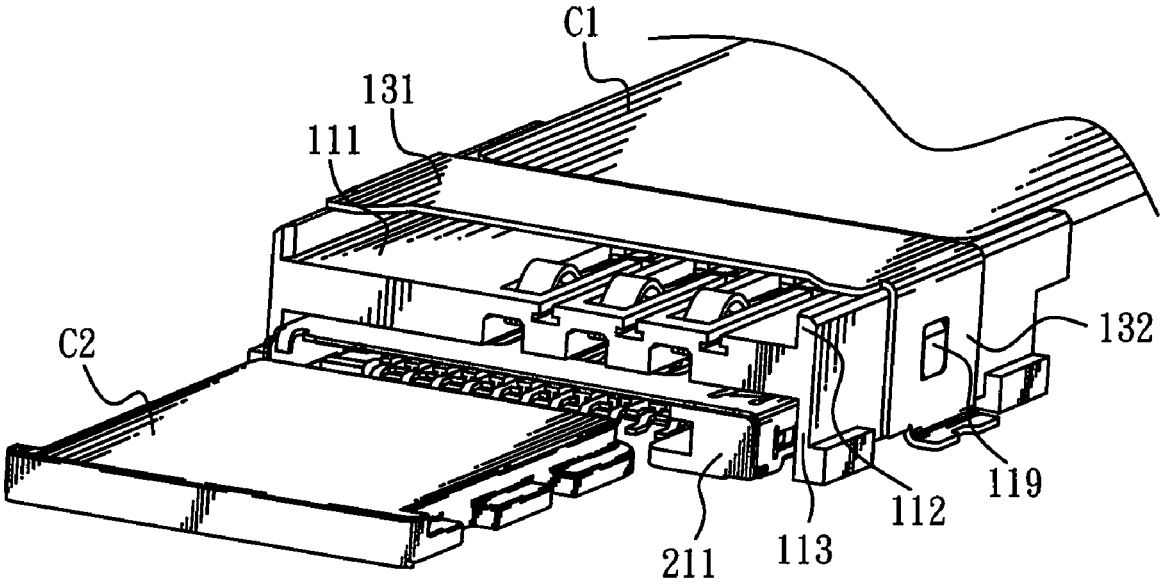
FIG. 6 is a schematic view illustrating state of a first electronic card and a second electronic card inserted into the electrical connector shown in FIG. 1.

Please refer to FIG. 6, in assembly, the second connector element 20 is removably accommodated in the receiving chamber 15 of the first connector element 10. The first insertion opening 141 of the first connector element 10 is opposite to the second insertion opening 251 of the second connector element 20 for conveniently inserting the electronic cards thereinto. That is, the first electronic card C1 should be inserted into the first receiving space 14 of the first connector element 10 from the rear end of the electrical connector 1, while the second electronic card C2 should be inserted into the second receiving space 25 of the second connector element 20 from the front end of the electrical connector 1.

As described above, the second connector element 20 is removably received in the receiving chamber 15 of the first connector element 10, which is not only capable of receiving the first and second electronic card C1 and C2, but also reduces occupied horizontal space of the electrical connector 1. Meanwhile, the first connector element 10 or the second connector element 20 can be alternatively exchanged when either the first connector element 10 or the second connector element 20 has a breakdown, which prolongs the usage life and reduces the manufacturing cost of the electrical connector 1. In addition, since the placed direction of the first and second soldering portions 1212, 1222 of the first terminal 12 is opposite to that of the soldering portion 222 of the second terminal 22, the first terminal 12 and the second terminal 22 are soldered on the PCB, respectively and separately, which can simplify welding process.

The foregoing description of the present invention has been presented for purposes of illustration and description. It is not intended to be exhaustive or to limit the invention to the precise form disclosed, and obviously many modifications and variations are possible in light of the above teaching.

Such modifications and variations that may be apparent to those skilled in the art are intended to be included within the scope of this invention as defined by the accompanying claims.

What is claimed is:

1. An electrical connector adapted for receiving a first electronic card and a second electronic card, comprising:

a first connector element, the first connector element including a first base of substantially rectangular shape, and a set of first terminals received in the first base, the first base having a first body, two lateral walls and two holding walls extending upwards and downwards from two opposite sides of the first body to form a first receiving space and a receiving chamber opposite to the first receiving space therebetween respectively, the first receiving space, with a first insertion opening defined, being adapted for receiving the first electronic card; and a second connector element removably received in the receiving chamber, the second connector element including a second base, a set of second terminals mounted in the second base and a second shell, the second shell engaged with the second base to form a second receiving space, with a second insertion opening defined opposite to the first insertion opening, for receiving the second electronic card.

2. The electrical connector as claimed in claim 1, wherein the first terminal includes a long terminal and a short terminal disposed parallel to the long terminal, the long terminal has a first soldering portion positioned out of the first base from an end thereof where the first insertion opening is defined and opposite to the lateral walls, and a first contacting portion opposite to the first soldering portion and projecting into the first receiving space for electrically connecting with the first electronic card.

3. The electrical connector as claimed in claim 2, wherein the second connector element is substantially rectangular, an end of the holding wall close to the first insertion opening is formed with a notch for indicating assembling position of the second connector element for avoiding influence on the first terminals.

* * * * *